US005193363A

United States Patent [19]

Petty

[11] Patent Number: 5,193,363

[45] Date of Patent: Mar. 16, 1993

[54] CONVEYOR ASSEMBLY APPARATUS

[75] Inventor: Larry K. Petty, Gastonia, N.C.

[73] Assignee: Milliken Research Corporation, Spartanburg, S.C.

[21] Appl. No.: 888,244

[22] Filed: May 22, 1992

Related U.S. Application Data

[63] Continuation of Ser. No. 613,341, Nov. 14, 1990, abandoned.

[51] Int. Cl.[5] ..... D06B 1/00

[52] U.S. Cl. ..... 68/205 R; 198/731; 198/733; 198/635; 198/592

[58] Field of Search ..... 198/725, 731, 733, 735.3, 198/851, 841, 607, 635, 614, 592, 463.5; 68/205 R

[56] References Cited

U.S. PATENT DOCUMENTS

| | | | |
|---|---|---|---|
| 2,439,040 | 4/1948 | Cohen | 198/731 |
| 2,816,647 | 12/1957 | Ruth | 198/725 |
| 3,073,430 | 1/1963 | Quinn | 198/635 |
| 3,080,042 | 3/1963 | Sherman | 198/463.5 |
| 3,202,260 | 8/1965 | Wolf | 198/635 |
| 3,213,999 | 10/1965 | Williams | 198/614 |
| 3,217,878 | 11/1965 | Rood et al. | 198/635 |
| 3,393,411 | 7/1968 | McElveen | 8/151 |
| 3,683,649 | 8/1972 | Takriti et al. | 68/5 D |
| 3,688,530 | 9/1972 | Harris et al. | 68/205 R |
| 3,731,503 | 5/1973 | Appenzeller et al. | 68/205 R |
| 3,788,455 | 1/1974 | Dieckmann | 198/841 |
| 3,892,109 | 7/1975 | Klein et al. | 68/205 R |
| 3,894,413 | 7/1975 | Johnson | 68/205 R |
| 3,937,045 | 2/1976 | Klein et al. | 68/205 R |
| 3,939,675 | 2/1976 | Klein | 68/205 R |
| 3,942,342 | 3/1976 | Klein et al. | 68/205 R |
| 3,942,343 | 3/1976 | Klein | 68/205 R |
| 3,969,779 | 7/1976 | Stewart, Jr. | 8/149 |
| 3,985,006 | 10/1976 | Klein | 68/205 R |
| 4,019,352 | 4/1977 | McCollough, Jr. et al. | 68/205 R |
| 4,033,154 | 7/1977 | Johnson | 68/205 R |
| 4,034,584 | 7/1977 | Klein et al. | 68/205 R |
| 4,055,868 | 11/1977 | O'Neill, Jr. | 8/150 |
| 4,058,991 | 11/1977 | McCollough | 68/205 R |
| 4,059,880 | 11/1977 | Klein | 29/157 |
| 4,095,444 | 6/1978 | Pascoe, Sr. et al. | 68/205 R |
| 4,097,946 | 7/1978 | McCollough | 8/150 |
| 4,116,626 | 9/1978 | Varner | 8/149 |
| 4,148,668 | 4/1979 | Stewart, Jr. | 134/22 C |
| 4,223,781 | 9/1980 | Beezer | 198/841 |
| 4,433,811 | 2/1984 | Godfrey | 239/74 |
| 4,434,632 | 3/1984 | McCollough, Jr. et al. | 68/205 R |
| 4,640,410 | 2/1987 | Palmaer et al. | 198/841 |
| 4,648,250 | 3/1987 | Yabe | 68/5 D |
| 4,720,008 | 1/1988 | Vfland | 198/841 |
| 5,000,438 | 3/1991 | Sardano et al. | 198/735.3 |

FOREIGN PATENT DOCUMENTS

| | | |
|---|---|---|
| 0061176 | 9/1982 | European Pat. Off. . |
| 978452 | 12/1964 | United Kingdom . |
| 1201598 | 8/1970 | United Kingdom . |

*Primary Examiner*—Joseph E. Valenza

*Attorney, Agent, or Firm*—Kevin M. Kercher; H. William Petry

[57] ABSTRACT

A conveyor apparatus used primarily in processing products such as applying liquids such as dyestuff by means of a patterned application of a moving stream of dye, having a first planar portion and an endless flexible element adjacent said first planar portion and a second planar portion adjacent said endless flexible element, where said flexible element has a series of slats mounted thereon that precisely coordinate the processed item underneath the processing element such as an element that provides patterned application of dye in order to achieve precise repeatable results.

21 Claims, 15 Drawing Sheets

CONVEYOR ASSEMBLY APPARATUS

CROSS-REFERENCE TO RELATED APPLICATION

This application is a continuation of U.S. patent application Ser. No. 07/613,341, filed Nov. 14, 1990, now abandoned.

BACKGROUND OF THE INVENTION

This invention relates generally to conveyor assemblies and particularly to a conveyor apparatus used in the patterned application of dyestuff or other liquids to carpeting that is in preferably the form of tile.

One major problem with current conveyors used for this application is the inability to align the carpet tiles properly on the conveyor to produce precise repeatable results when being sprayed by electronically controlled gun bars in the form of intricate patterns. One reason for this is the use of dual chains on each side of the conveyor that align and position the carpet tiles on the conveyor. These chains can expand and become misaligned, which causes the slats to be no longer perfectly perpendicular with the longitudinal axis of the conveyor thereby patterning either earlier or later then required for repeatable precise patterned carpet tiles.

The present invention solves the above problem and others in a manner not disclosed in the known prior art.

SUMMARY OF THE INVENTION

A conveyor apparatus used primarily in processing products such as applying liquids such as dyestuff by means of a patterned application of a moving stream of dyestuff, having a first planar portion and an endless flexible element adjacent said first planar portion and a second planar portion adjacent said endless flexible element, where said flexible element has a series of slats mounted thereon that precisely coordinate the processed item underneath the processing element that provides patterned application of dyestuff in order to achieve precise repeatable results.

It is an advantage of this invention to be able to maintain processed material, i.e., carpet tiles, in a fixed location perpendicular to the longitudinal axis of the conveyor for repeatable precise processing.

It is another advantage to remove processed material by means of lifters and a take-off conveyor so that there is no load placed on the alignment slats.

These and other advantages will be in part obvious and in part pointed out below.

BRIEF DESCRIPTION OF THE DRAWINGS

The above as well as other objects of the invention will become more apparent from the following detailed description of the preferred embodiments of the invention, which when taken together with the accompanying drawings, in which.

Corresponding reference characters indicate corresponding parts throughout the several views of the drawings.

DETAILED DESCRIPTION OF THE PREFERRED EMBODIMENT

Figure 1:
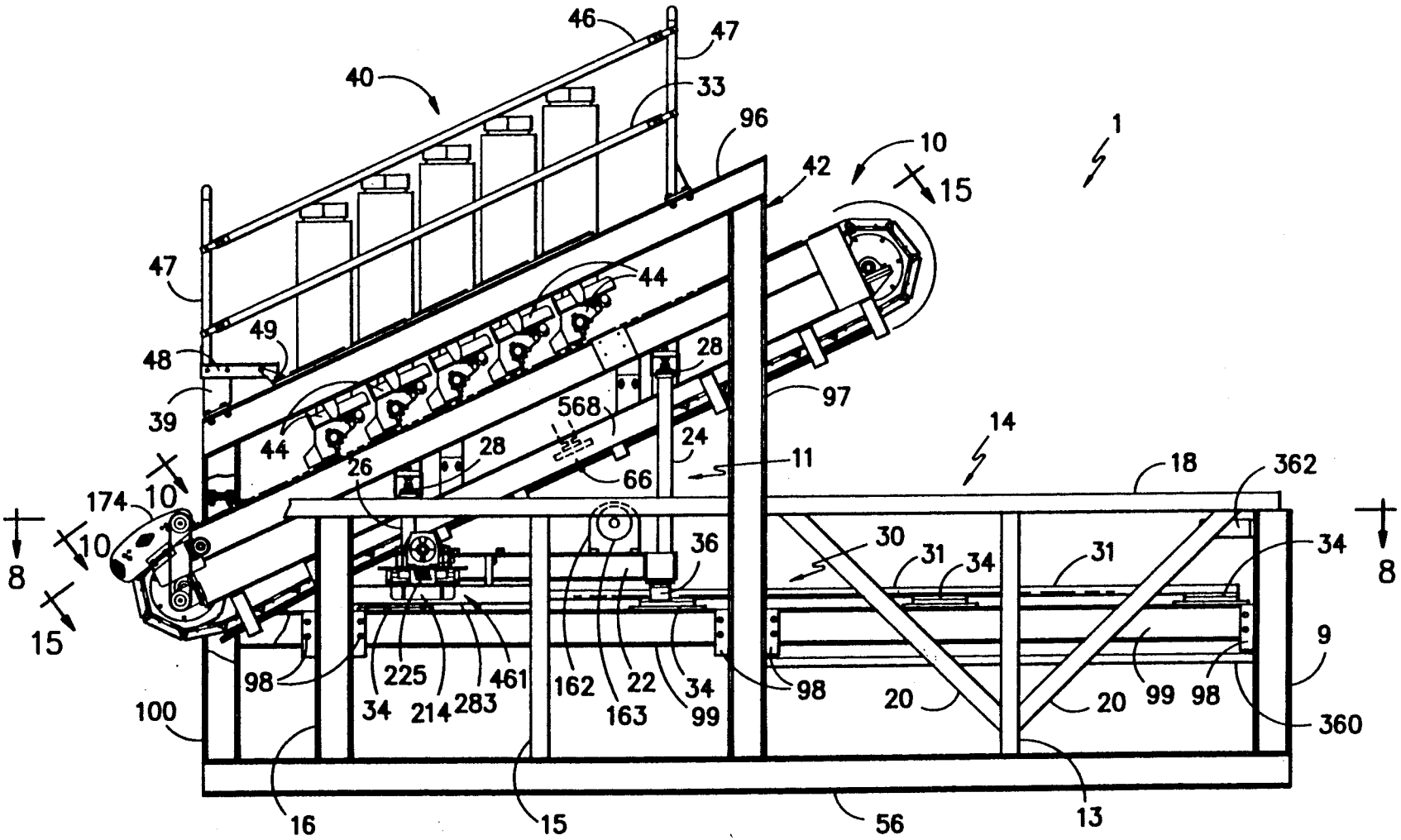
FIG. 1 is a side elevational view of the conveyor apparatus of the present invention used in the patterning of textile materials by the application of dyestuff.

Referring more specifically to the drawings, FIG. 1 discloses an overall side elevational view of the apparatus for conveying material to which the present invention pertains. As shown and will be described, the apparatus is particularly adapted for transporting pile carpet material that is processed by the application of dyestuff in the form of a pattern. However, it will be understood that this conveyor assembly could be employed for transporting a variety of material in a wide spectrum of applications. All of the mechanical attachments in this invention may be accomplished by any of a wide variety of conventional hardware, adhesives, and so forth.

Figure 8:
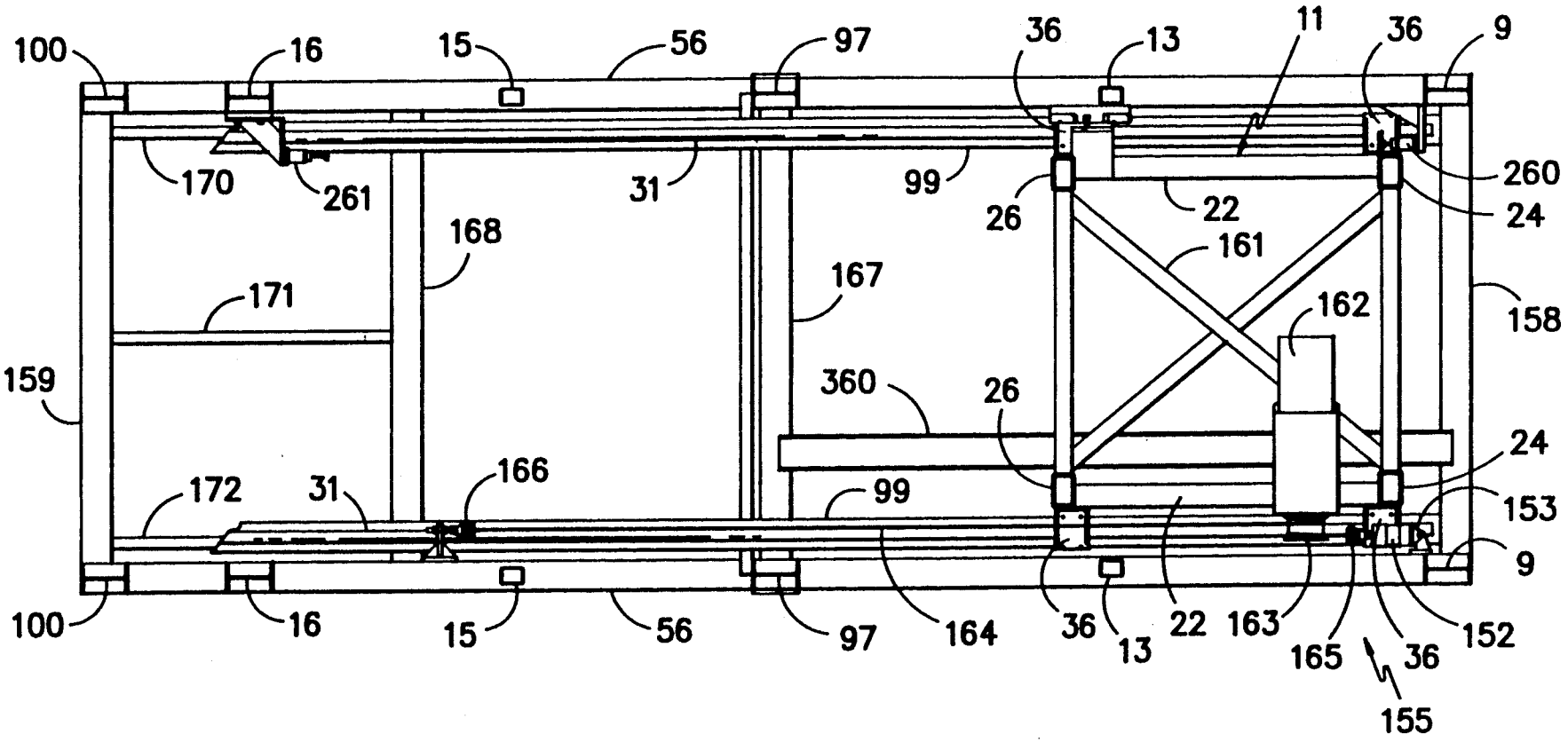
FIG. 8 is a cross-sectional view taken along line 8—8 of FIG. 1.
Figure 13:
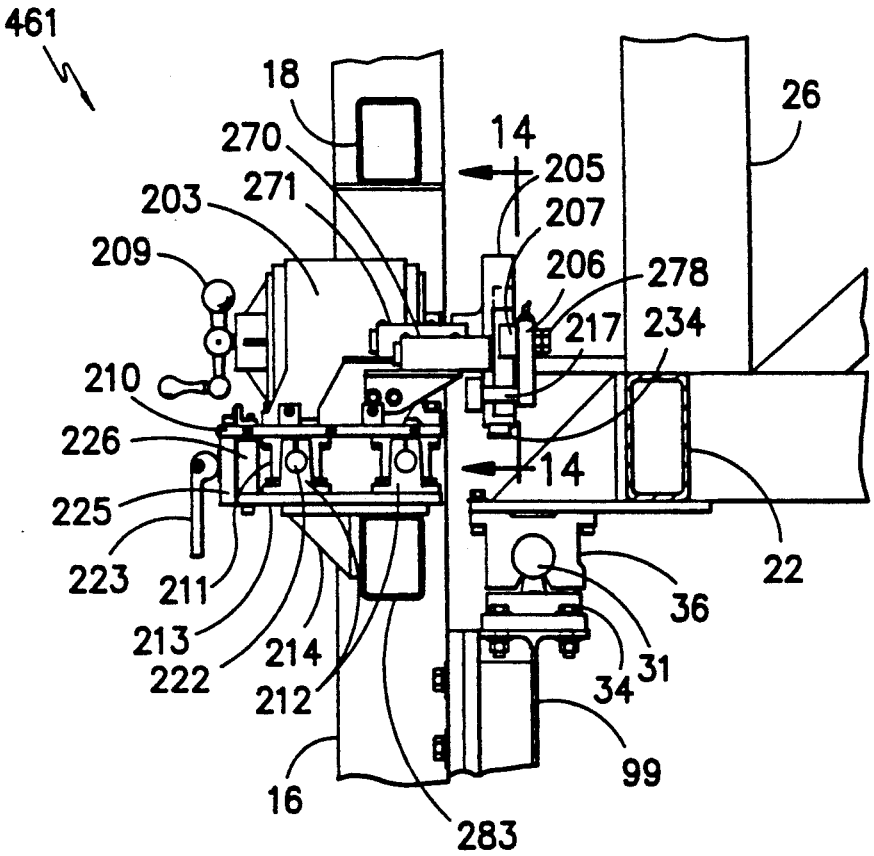
FIG. 13 is a right side elevational view of the carriage lock assembly.

The conveyor apparatus shown in FIG. 1 comprises a main conveyor apparatus generally indicated by numeral 1 with the conveyor mechanism proper indicated by numeral 10. There is a main support frame assembly 14 that is identical on both the left side and the right hand side, which includes horizontal base I-beam supports 56 supporting upper horizontal rails 18 by means of vertical I-beam supports 9 and 16, respectively. There are two ancillary vertical supports 15, 13 that also connect the horizontal base I-beam support 56 with the upper horizontal rail 18. Ancillary vertical support 13 has two transverse members 20 extending from the lower portion thereof on both sides to the upper horizontal rail 18. There is a horizontal support member 362 extending between the transverse member 20, which is on the right of ancillary vertical support 13 in FIG. 1, and vertical I-beam support 9. The conveyor mechanism 10 has a support system numerically delineated as numeral 11 comprising of dual horizontal support I-beams 22 forming the carriage weldment assembly with a longer rear vertical support member 24 and a comparatively shorter front vertical support member 26. There is a lateral support member 568 extending between the upper portions of vertical support members 24 and 26. Both vertical support members 24 and 26 have a leveling pad adjustment mechanism 28 that attaches to the conveyor mechanism 10. The leveling pad adjustment mechanism 28 comprises of a combination of hex head cap screws, hex head jam nuts and washers that are connected to an angle support bracket and is used to level the conveyor mechanism 10. The conveyor mechanism support system 11 and the main support frame assembly 14 are interconnected by means of a rail system indicated generally at numeral 30. Rail system 30 includes carriage I-beam tracks 99 located on the left and right hand side of the main conveyor apparatus 1 and running longitudinally along its length and attached to the vertical I-beam supports 9 and 16 by means of support brackets 98. Cylindrical rails 31 are attached to each of the carriage I-beam tracks 99 by means of rail support spacers 34. The conveyor mechanism support system 11 can move along the cylindrical rails 31 by means of four Thomson® pillow block bearings 36, which are in effect open linear bearings and available from Thomson Industries of Port Washington, New York which surround and ride the cylindrical rails 31 and that are located on each side of the main conveyor apparatus 1 with one mounted underneath and outward from horizontal support I-beam 22 and below and outward from rear vertical support member 24 and the other pillow block linear bearing 36 also mounted underneath horizontal support I-beam 22 and below and outward from front vertical support member 26, as shown in FIGS. 8 and 13.

The dyeing apparatus shown generally as numeral 40 is supported by a main dye applicator support frame 42. There is a main dye apparatus forwardly slanting support member 96 with a relatively longer rear dye apparatus vertical support member 97 and a relatively shorter front dye apparatus vertical support member 100 attached thereto. The front dye apparatus vertical support member 100 is attached to horizontal base I-beam support 56 at the base of the main conveyor apparatus 1. The rear dye apparatus vertical support 97 is also attached to the carriage I-beam track 99 by means of support bracket 98. There is a horizontal support beam 360 extending between rear dye apparatus vertical support 97 and vertical I-beam support 9.

The dyeing apparatus 40 is disclosed in U.S. Pat. No. 3,393,411, U.S. Pat. No. 3,894,413, U.S. Pat. No. 3,942,343, U.S. Pat. No. 4,019,352, U.S. Pat. No. 4,202,189, U.S. Pat. No. 4,033,154, U.S. Pat. No. 4,034,584, U.S. Pat. 4,116,626, U.S. Pat. No. 4,309,881, U.S. Pat. No. 4,434,632, and U.S. Pat. No. 4,584,854. The subject matter disclosed in each of the eleven U.S. Patents identified hereinabove is hereby incorporated by reference into the instant disclosure.

Positioned above and spaced along the length of main conveyor mechanism 10 are a plurality of dye applicator members, or gun bar assemblies 44, which extend in parallel, spaced relation across the width of the conveyor mechanism 10. There are hand rails 46 on each side of the gun bar assemblies 44 supported by vertical members 47 and having an intermediate support member 33 in parallel with the hand rails 46. For pattern dyeing broadloom carpets the gun bar assemblies 44 are each provided with a different color dye in order to apply a colored pattern to the carpet. The length of the conveyor may vary depending on the number of gun bar assemblies used. There is an access platform 48 attached to the main dye apparatus slanting support means by vertical bracket 39 and angle bracket 49. There are two lateral bracing members (not shown) found at the rear of the main conveyor apparatus for support.

Figure 2:
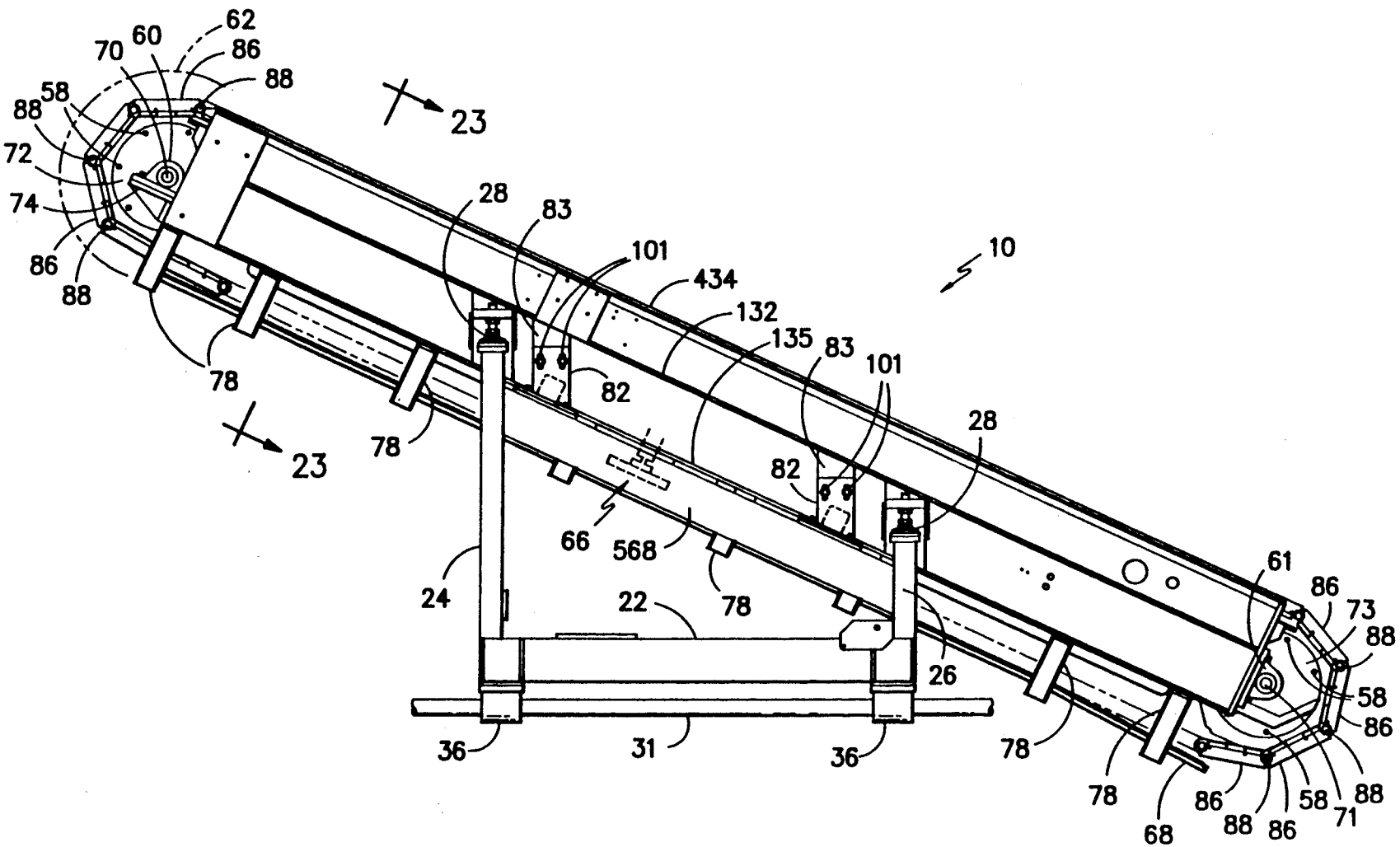
FIG. 2 is an enlarged side elevational view of the isolated conveyor mechanism and dual support members.
Figure 15:
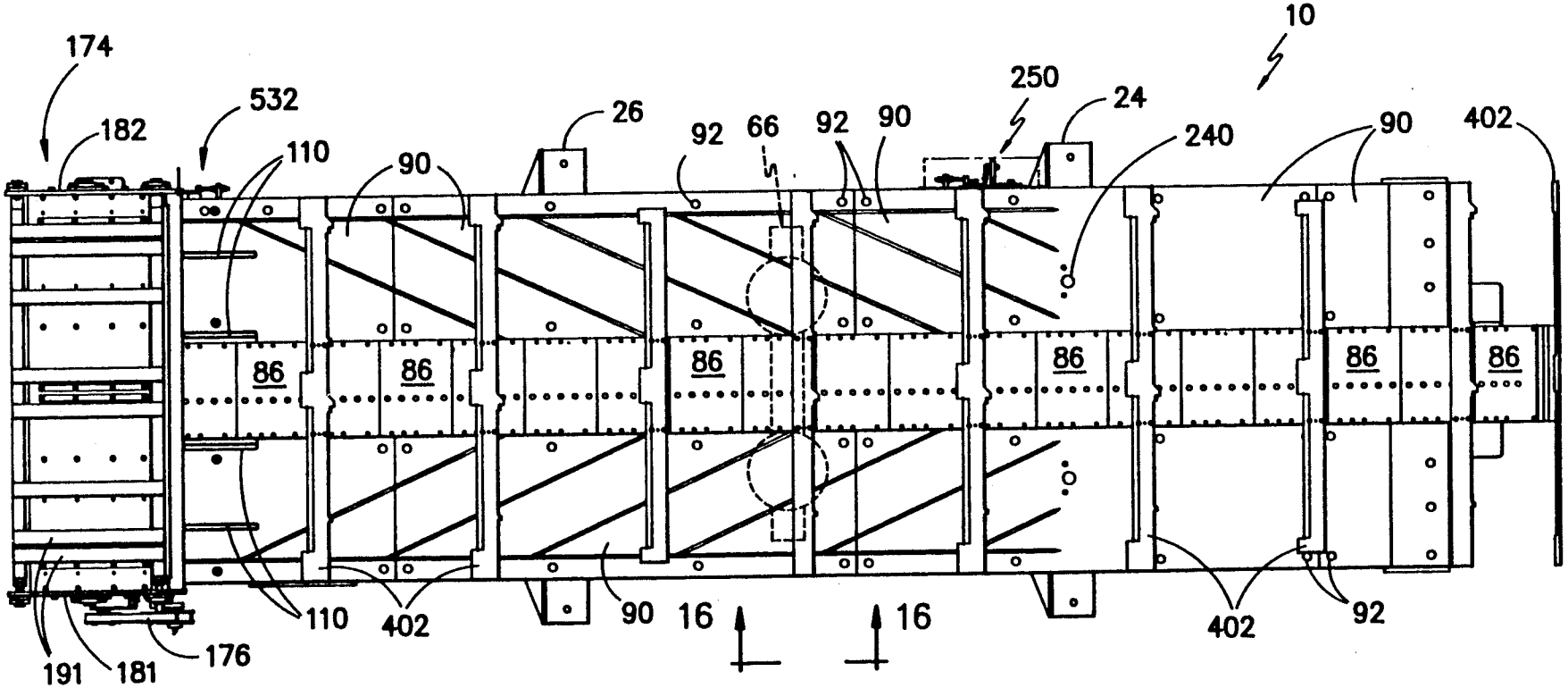
FIG. 15 is a cross-sectional view taken on line 15—15 of FIG. 1.

Referring now to FIG. 2 which isolates the conveyor mechanism 10, the main conveying means of this invention is an endless loop of conveyor plates 86 that are connected by linking pin joints 88 that rotate in a hinge-like manner to provide flexibility. The main portion of the conveyor mechanism 10 has an upper layer 434, intermediate layer 132 and lower layer 135. There is a transport link return guidance assembly 66, as shown in FIGS. 1, 2 and 15, for the underside of the conveyor to maintain the conveyor plates 86 in lateral alignment along the longitudinal axis. There are slats 402 that can be removedly attached to conveyor plates 86 and travel along slat support runners 68 with associated channel plates on the underside of the conveyor, as shown in FIGS. 2, 3, 4, and 9. There are eight "U" shaped support brackets 78 that hold the slat support runners in 1 position. The main conveyor mechanism 10 is stabilized by the upper and lower interconnecting stabilizers denoted by numerals 83 and 82, respectively, which are connected by any attachment means such as hex head cap screws and flat and locking washers located at numeral 101. Each opposing longitudinal end of the conveyor mechanism 10 has an upper and lower pin wheel 72 and 73 respectively. Each pin wheel 72, 73 has seven sides and is mounted on a respective shaft 70, 71 that rotates within a respective pillow block linear bearing 60, 61. Pillow block linear bearing 60 is mounted on a mounting bracket assembly 74, while pillow block linear bearing 61 is mounted directly to the front of conveyor mechanism 10. The upper pin wheel 72 is protected from access by a stand-off load station guard 62. The pin wheels 72, 72 guide and rotate the conveyor plates 86 that travel the longitudinal length through the lateral center of the conveyor mechanism 10.

Figure 3:
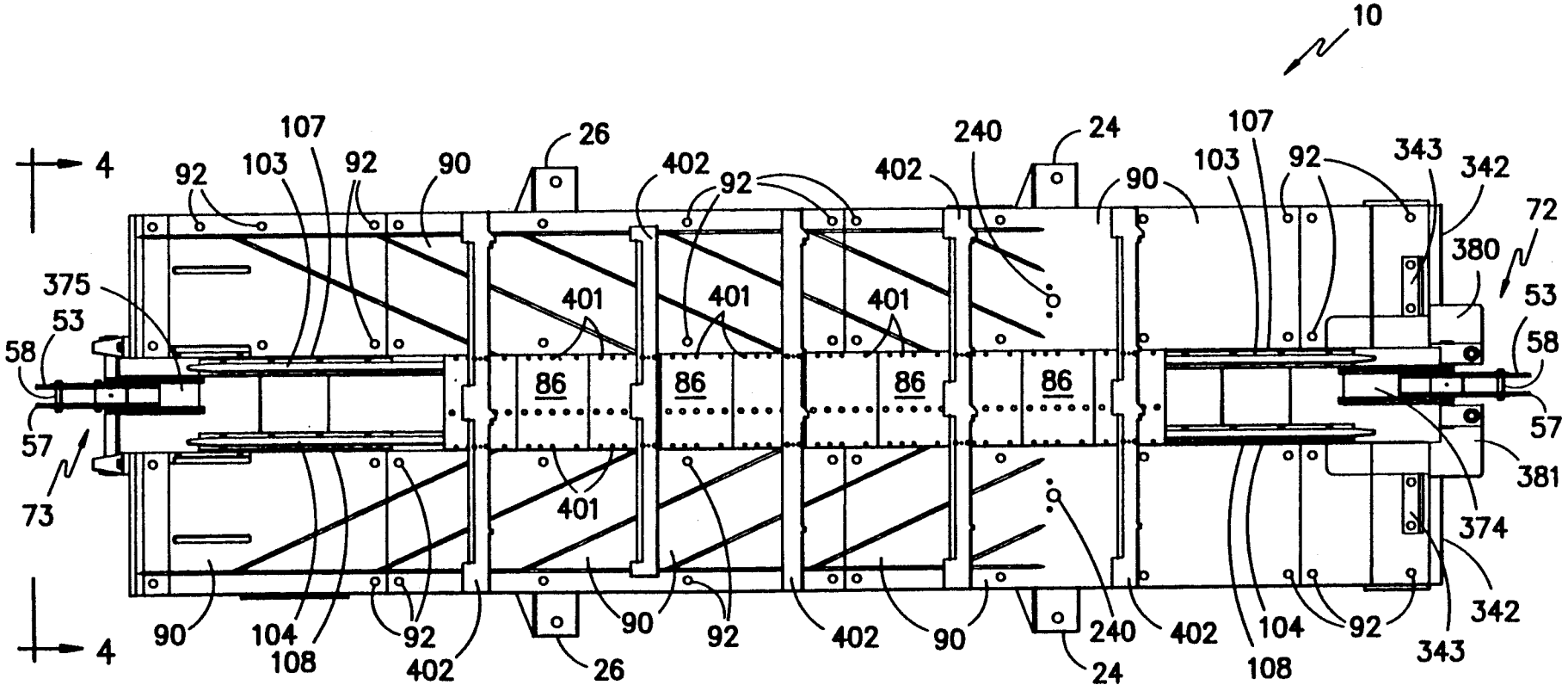
FIG. 3 is a top plan view of the conveyor mechanism.
Figure 4:
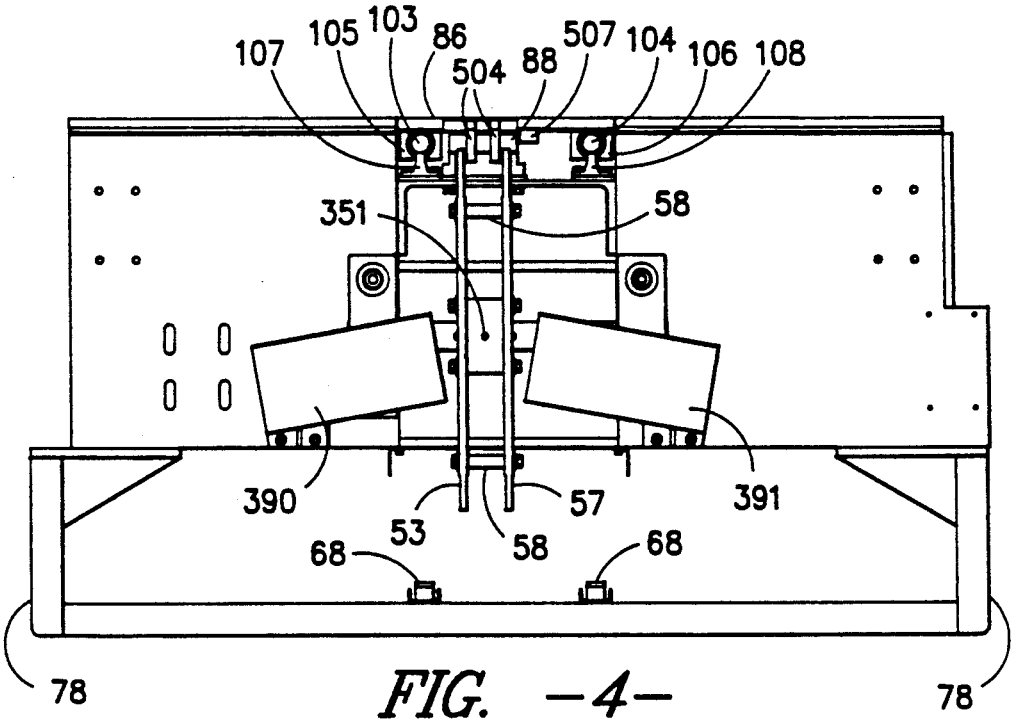
FIG. 4 is a cross sectional view taken on line 4—4 of FIG. 3.

Referring now to FIGS. 3, 4 and 15, there are panels 90 on each side of the moving conveyor plates 86. These panels 90 are made from a product manufactured by E. I. du Pont de Nemours & Company of Wilmington, Del. called CORIAN® that is traditionally used as a material for countertops and can be categorized as a type of plastic. However, a wide variety of materials may be used as a conveyor surface as well as a surface may be used underneath such as a quarter of one inch of aluminum. These panels are attached to the top of the conveyor mechanism 10 by means of bolts 92 or other attachment means. The moving conveyor plates 86 have linear pillow block linear bearings 105, 106 mounted underneath the moving conveyor plates 86 that ride on and enclose cylindrical shafts 103, 104, as shown in FIG. 4. The longitudinal shafts 103, 104 are mounted on support rails 107, 108 that extends longitudinally with said shafts 103, 104. The conveyor plates 86 have numerous tapped holes with inserts 401 upon which can be attached a slat 402 or plurality thereof that extends across the width of the conveyor mechanism 10 and can accommodate a variety of product of various lengths, i.e., carpet tile.

The upper and lower pin wheels 72 and 73, respectively, have two parallel plates 53 and 57 that are separated by cylindrical spacers 58 attached by an associated screw and nut. There is an interconnection member 351 between adjacent spacers 58, as shown in FIG. 4. There is a pin wheel support bar 374, 375 located at each end of the conveyor mechanism 10 located at the rear and front of the conveyor mechanism respectively. There is also a left hand mounting bracket 380 and a right hand mounting bracket 381 for the upper pin wheel 72. As shown in FIG. 4, there is both a left hand drip shield 390 and right hand drip shield 391 positioned underneath the longitudinal shafts 103 and 104 respectively. Located at the rear of the conveyor mechanism 10 is a slat protector 342 and mounting angle 343.

Figure 5:
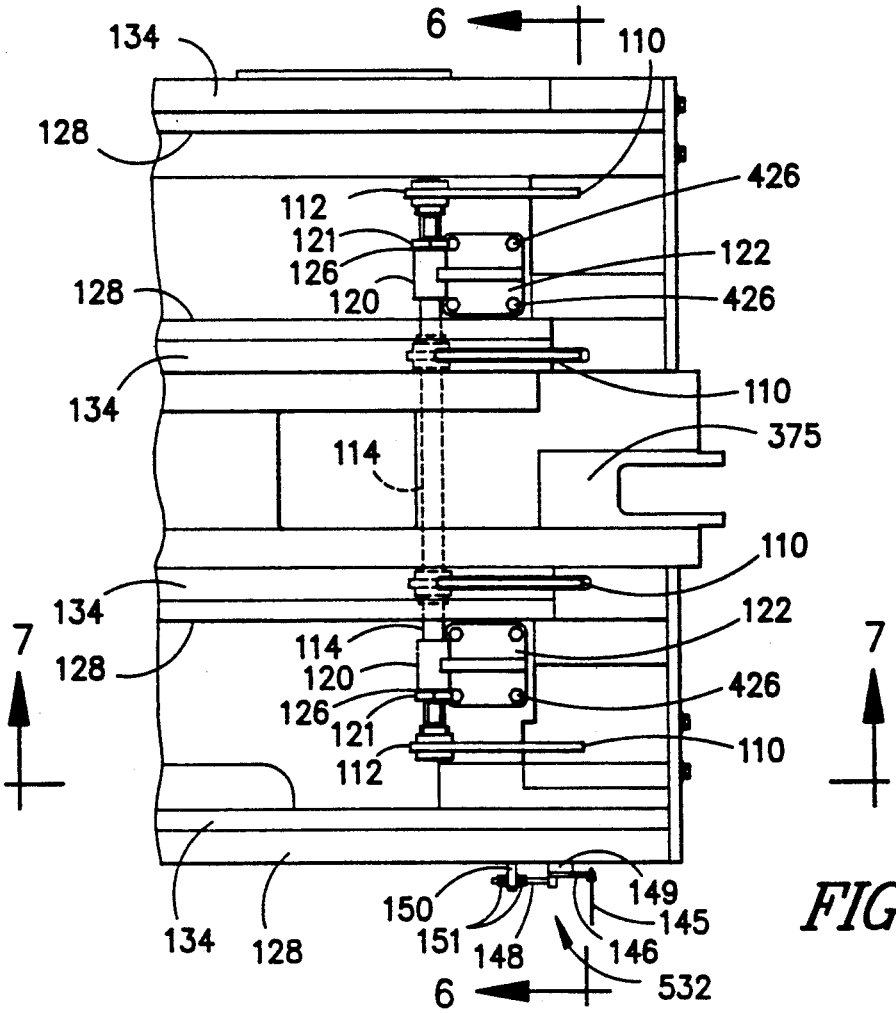
FIG. 5 is a top plan view of the lifter mechanism.
Figure 6:
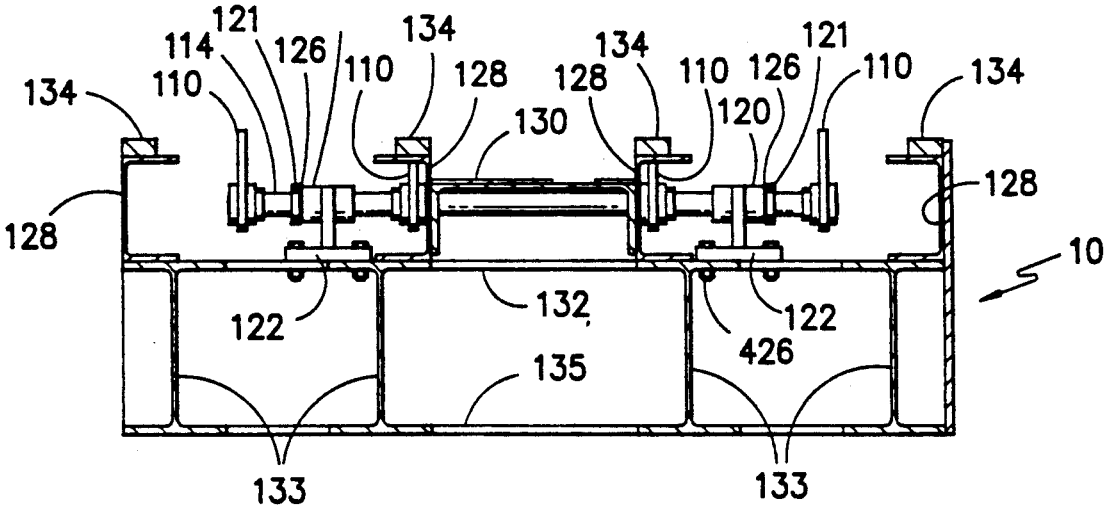
FIG. 6 is a cross-sectional view taken along line 6—6 of FIG. 5.
Figure 7:
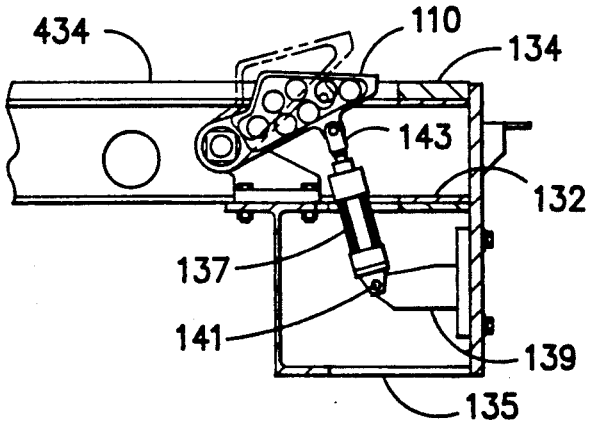
FIG. 7 is a cross sectional view taken along line 7—7 of FIG. 5.

Referring now to FIGS. 5 and 6, the mechanical lifter 110 is a means to flip objects from out the end of the bottom end of the conveyor mechanism 10. The lifter 110 is connected to a shaft 114 by means of an attachment mechanism 112. The attachment mechanism 112 is called a Trantorque® unit that is manufactured by Fenner Manheim of Manheim, Pa. and is connected to the shaft 114. The attachment mechanism 112 will rotate in place around the shaft 114 if opposed by more than 1800 inch/pounds of torque. This will protect the lifters 110 if they come into contact with any slats 402 mounted to the conveyor plates 86. The shaft 114 is held in a fixed position by a combination of a two piece clamp collar 121 and thrust bearing 126. The shaft 114 is rotatively mounted in a sleeve bearing 120 having the trademark Rulon® and is manufactured by Dixon Industries Corporation of Bristol, Rhode Island that is connected to a mounting bracket 122 that is attached to the conveyor mechanism 10 by a series of four bolts 426 at an intermediate level 132. The conveyor mechanism 10 has a lower layer 135 that connects to the intermediate layer 132 by means of vertical support members 133. There are u-shaped members 128 with rectangular blocks 134 affixed thereto that is attached as a unit to the top of the intermediate layer 132. Please note that the upper layer 434 comprising of panels 90 on top of a one-quarter inch of aluminum as shown in FIG. 7, is not shown in FIGS. 5 and 6. There is a flat cover plate 130 that conceals the middle of shaft 114.

There is a fiber optic sensor assembly generally indicated as numeral 532 comprising a fiber optic sensor 145 utilized to detect the presence of an object, such as a carpet tile, on the end of the conveyor 10 as shown in FIGS. 5 and 15. The sensor 145 is connected to a mounting plate 146 by means of a hex head cap screw and washers that is then attached to a spacer 149 that is attached to the conveyor mechanism 10 by means of a socket head cap screw. There is an adjustment rod 148 attached to the mounting plate 146 by means of cup point socket set screw that moves within an adjustment block 150 that is mounted to the side of the conveyor 10 by means of hex head cap screws and washers. This allows for positioning of the sensor by means of the longitudinal positioning of hexagonal nuts 151.

Referring now to FIG. 7, the mechanical lifter 110 is actuated by means of a cylinder 137 with preferably a one and one-half inch bore and a two inch stroke. The cylinder 137 is pivotally attached to the end of the conveyor mechanism 10 by means of a mounting bracket 139 and pivot pin 141. The lifter 110 is attached to the cylinder 137 by means of a clevis 143 using a hexagonal jam nut.

The conveyor assembly base generally indicated as numeral 155, as shown in FIG. 8, has dual longitudinal support members 56 between two end members 158 and 159. The conveyor mechanism support system 11 with interacting cross beams 161 allows the conveyor mechanism 10 to be able to move away from and underneath the gun bar assemblies 44. This movement is actuated by means of a motor 162, also shown in FIG. 1, such as a one horsepower, 1750 r.p.m., 240 volt d.c. motor operating in conjunction with a c-face, triple reduction, parallel reducer at a 129:1 ratio, which has a carriage drive pulley 163 that winds and unwinds a cable 164 that is stretched between two cable clips 165 and 166. There is an air cylinder 152 attached to cable clip 165 that is fastened to the longitudinal support member 56 by means of bracket 153. There are shock absorbers 260 and 261 mounted on L-shaped mounting brackets and located at each end of relative travel of the conveyor support system 11. There are two members 167 and 168 that interconnect and are perpendicular to longitudinal support members 56. There are also three support members 170, 171 and 172 that interconnect members 168 and 159 and a horizontal support beam 360 that interconnects and is perpendicular to lateral support members 167 and 158.

Figure 9:
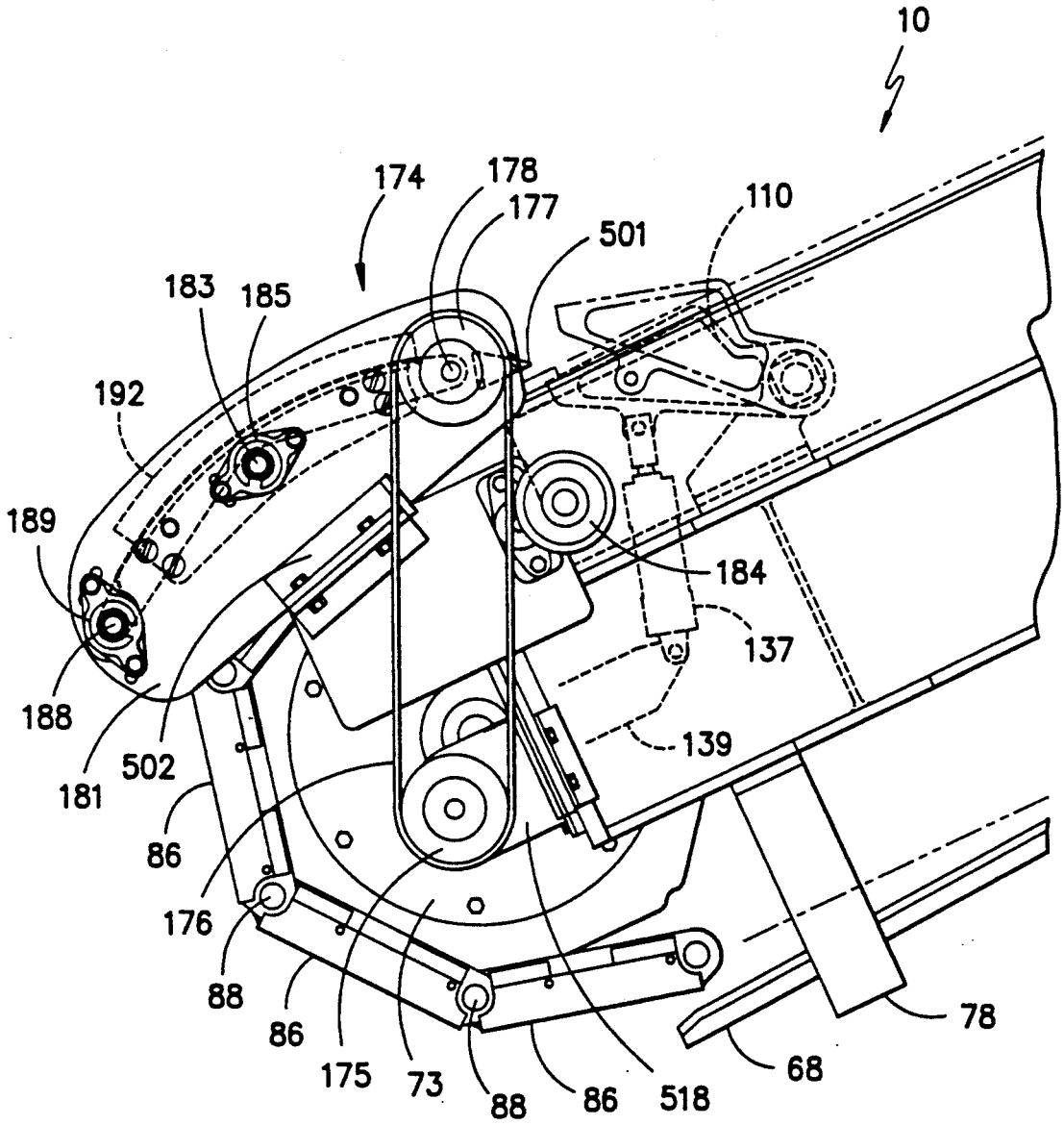
FIG. 9 is a side elevational view of the take-off conveyor assembly.
Figure 10:
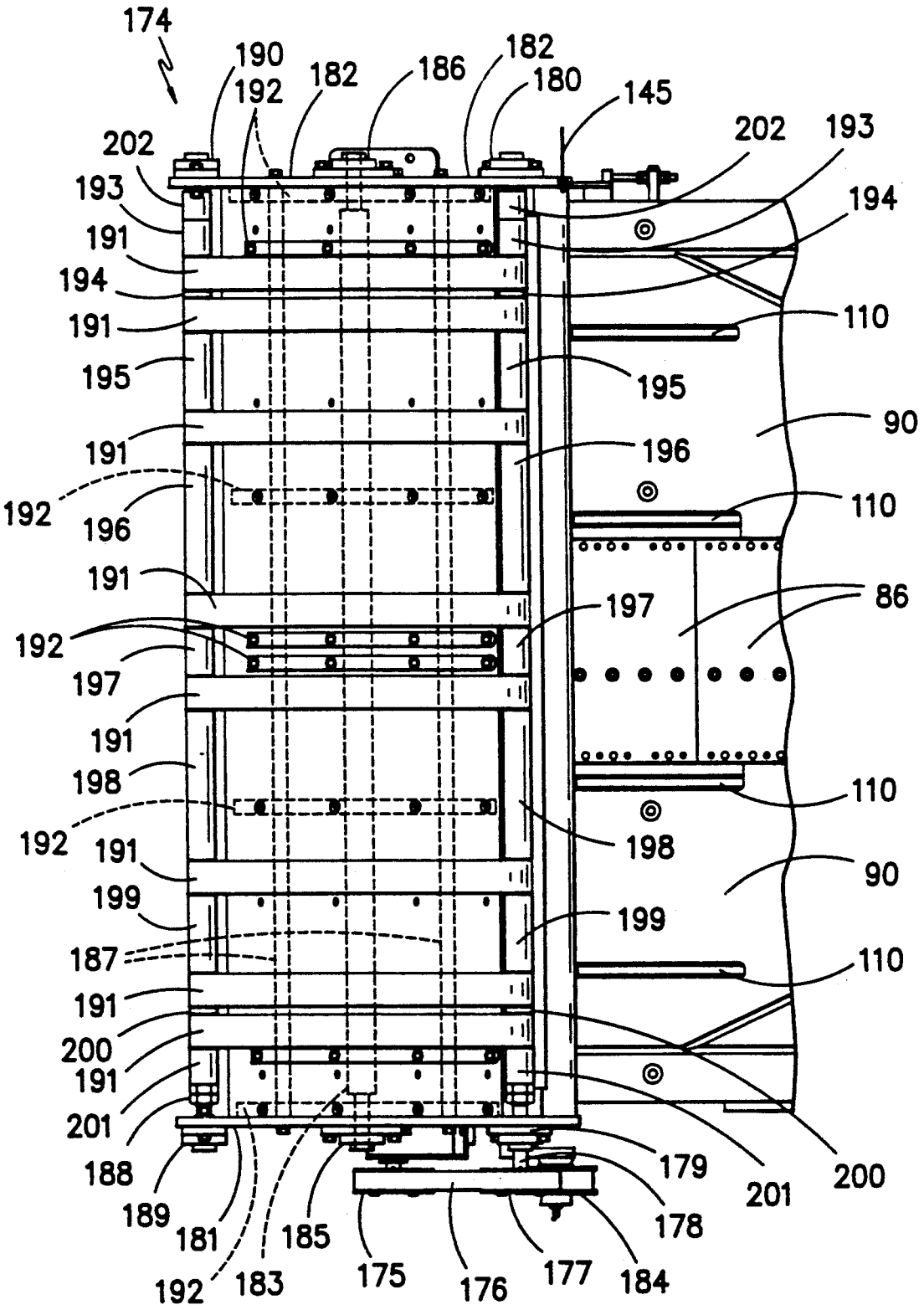
FIG. 10 is a cross-sectional view taken along line 10—10 of FIG. 1.

Referring now to FIGS. 9, 10, and 15, the take-off conveyor is shown generally by numeral 174, as well as in FIGS. 1 and 15, is mounted to the end of the conveyor mechanism 10 by mating L-shaped mounting brackets 502. Tiles are sensed by fiber optic sensor 145, as shown in FIGS. 5 and 10, and then placed on the take-off conveyor 174 by mechanical lifter 110 in conjunction with a triangular tile transfer bar 501, with the lifter 110 being actuated by a cylinder 137 that is fixedly attached to the end of the conveyor by mounting bracket 139. The pin wheels 72, 73 guide the endless loop of conveyor plates 86 with linking pin joints 88 around the conveyor mechanism 10. The take-off conveyor 174 is powered by a pulley 175 driven by a one-fourth horsepower, 3-125 r.p.m., 90 volt DC motor (not shown) that is mounted by angle bracket 518 to the front end of the conveyor mechanism. The pulley 175 drives another pulley 177 by means of a continuous belt 176, as shown in FIGS. 9 and 10. Pulley 177 is connected to drive shaft 178 that traverses the width of the take-off conveyor 174 and is held in position by flange bearings 179 and 180 that are held in position by side plates 181 and 182 respectively. There is a flat face idler 184 that is used to maintain pressure on the belt 176 and is connected to a shaft by means of a tightener (not shown). Toward the center of the side plate 181 as well as side plate 182 is an idler shaft 183 that is rotatable held in position by flange bearings 185 and 186 respectively. Positioned on each side of the idler shaft 183 are positioning rods 187 that extends between side plates 181 and 182 and is connected only by bolts and not bearings. At the end of take-off conveyor 174 is a belt tensioning shaft 188 held in position by bearings 189 and 190 that are also mounted on side plates 181 and 182 respectively. There are eight continuous belts 191 that rotate around the take-off conveyor 174 by means of shafts 178 and 188 while rotating shaft 183. There are eight support ribs 192 positioned longitudinally along the width of the take-off conveyor 174. On both the front and back of the take-off conveyor 174 and from left to right, there are belt spacers 202, 193, 194, 195, 196, 197, 198, 199, 200, and 201. This allows the continuous belts 191 to travel in predefined paths.

Figure 14:
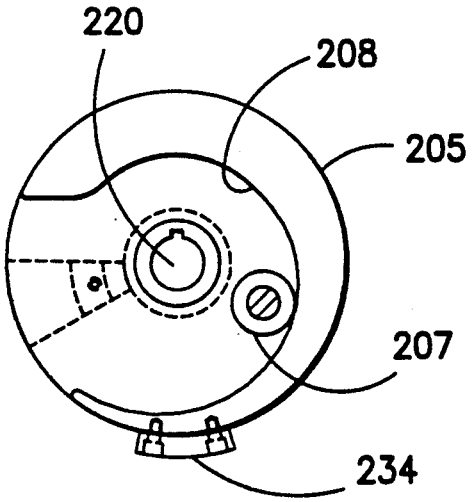
FIG. 14 is a cross-sectional view taken on line 14—14 of FIG. 13.

Referring now to FIGS. 1, 11, 12, 13, and 14, the conveyor mechanism 10 can be adjusted to process various heights of carpet tile by moving the conveyor mechanism support system 11 to numerous fixed points underneath the slanting gun bar assemblies 44 by means of a locking assembly generally indicated as numeral 461. Conveyor mechanism support system 11 comprises vertical support members 24 and 26 mounted on the horizontal support I-beam 22 that is connected to Thomson ® pillow block linear bearings 36 that ride on the cylindrical rail 31 that is attached to the rail support spacers 34 that are connected to the carriage I-beam track 99. A main component of the locking assembly 461 is a helical gear reducer 203 operated by a handwheel 209. The helical gear reducer 203 controls a locking cam 205 by encircling a bearing 207 that is attached to a hydraulic lubricating fitting and associated bar 206 by means of hex jam nuts 278. This encirclement of the bearing 207 is what locks the conveyor mechanism support system 11 in place. As shown in FIG. 14, the locking cam 205 has an elevated rim 208 around approximately three-quarters of its circumference. The locking cam is attached to the helical gear reducer by a socket set cup point 220. There is a cam lock switch target 234 attached to the side of the locking cam 205 by two socket head cap screws.

The helical gear reducer 203 is attached to the main cover mounting angle 210 that has Thomson ® pillow block linear bearings 211 attached to the underside thereof, which ride on dual index shafts 222 held in position on each side of their three (3) inch length by support blocks 212 that are attached to an index block 213. The index block 213 is attached to a L-shaped index base 214 that is connected to a lateral index support member 283 that connects vertical I-beam support 16 and ancillary vertical support 15. There is an outer index block 225 having fifteen (15) separate locations for varying heights of carpet or other processed articles that connect to holes in inner index block 226 by means of an expanding pin 223 that holds the locking assembly 461 in a fixed location with relation to the index shafts 222.

There is a sensor 270 that is triggered when a carriage sensor switch target 217 passes beneath it. The carriage sensor switch 217 is connected to the bar 206 and comprises a spacer and socket head cap screw. Sensor 270 is attached to a mounting bracket 267 that is attached to a mounting plate 265 that connects to a mounting post 266 that is connected to the lateral index support member 283. The signal from the sensor 270 goes to the control system that regulates by slowing down the motor 162 of FIG. 8. Closer to the helical gear reducer 203 is another sensor 271 which is also triggered by the carriage sensor switch target 217, but this time the control system stops the rotation of motor 162.

Figure 11:
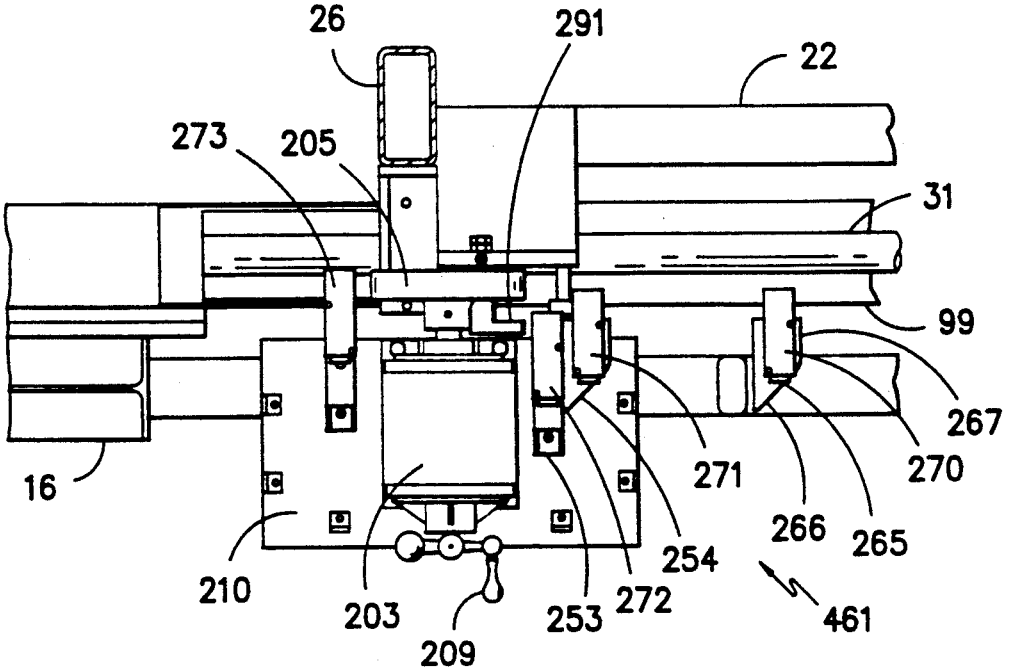
FIG. 11 is a top plan view of the carriage lock assembly.
Figure 12:
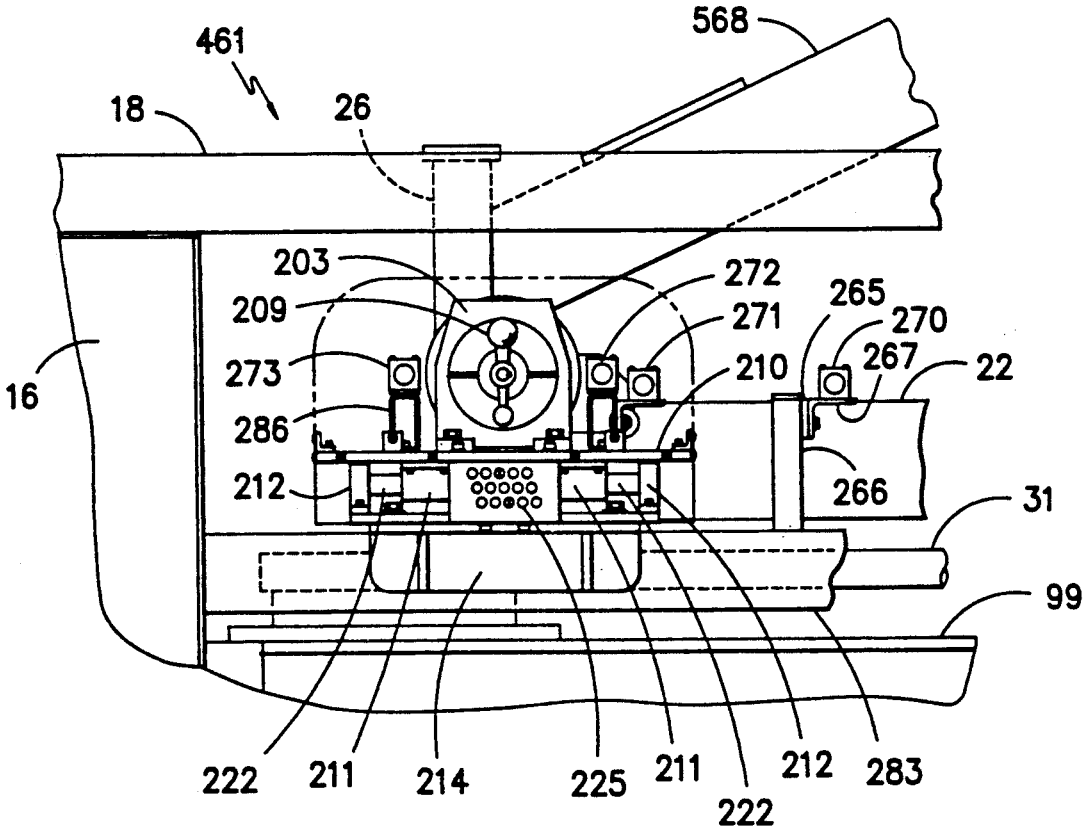
FIG. 12 is a front elevational view of the carriage lock assembly.

There is a cam unlock sensor 272 that is located on the right of the locking cam 205 in FIG. 11 and looks toward the cam 205. There is a cam unlock switch target 291 that is attached to the locking cam 205 that triggers the sensor 272. The cam unlock sensor 272 has a mounting bracket 253 attached to mounting angle 210. The mounting bracket 254 for sensor 271 is attached to mounting bracket 253. There is cam lock sensor 273 that is located on the left of the locking cam 205 and looks toward the cam and is triggered by the cam lock switch target 234. Cam lock sensor 273 is mounted on mounting bracket 286.

Figure 16:
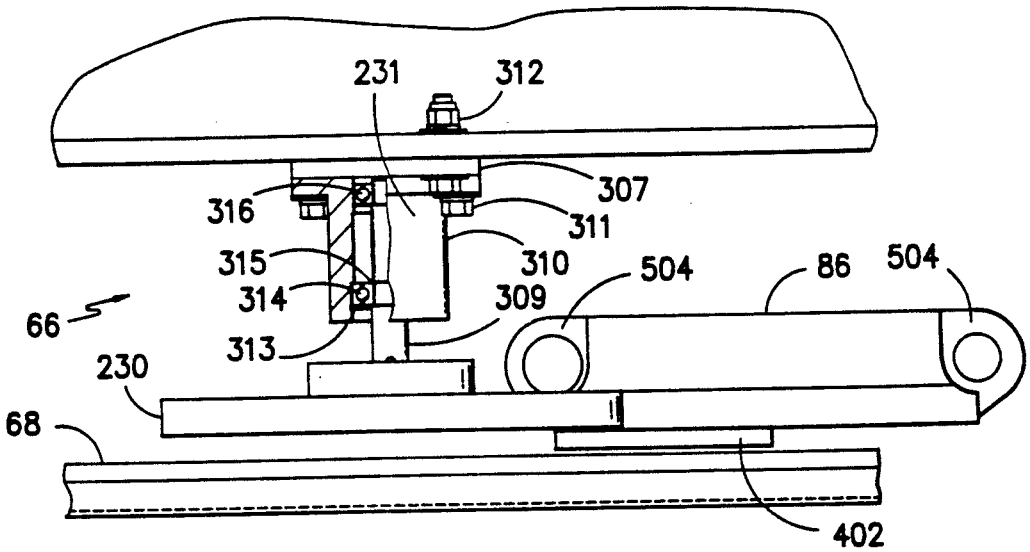
FIG. 16 is a cross-sectional view taken on line 16—16 of FIG. 15.
Figure 17:
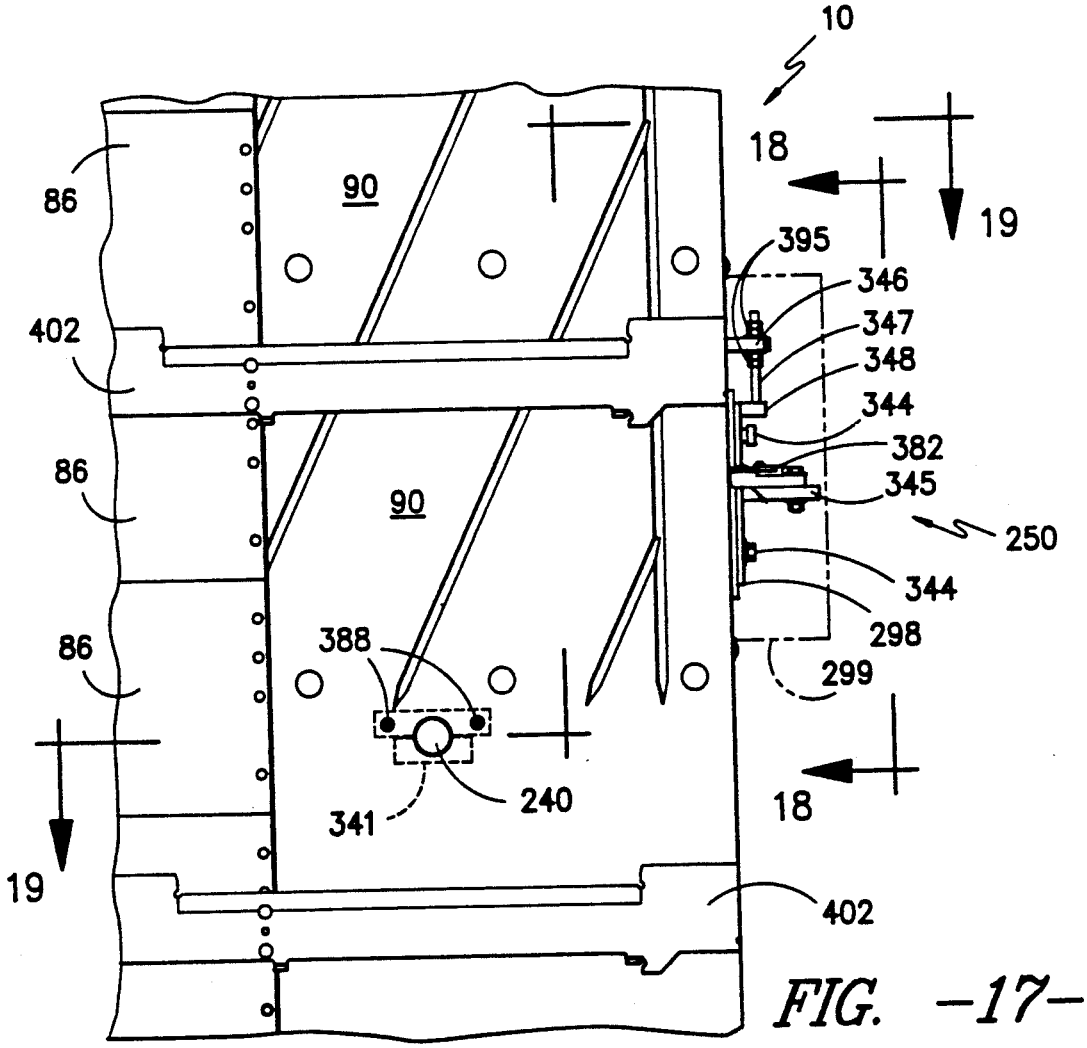
FIG. 17 is an isolated top plan view of the conveyor assembly including a missing tile detector sensor assembly and a process initiation sensor assembly.
Figure 18:
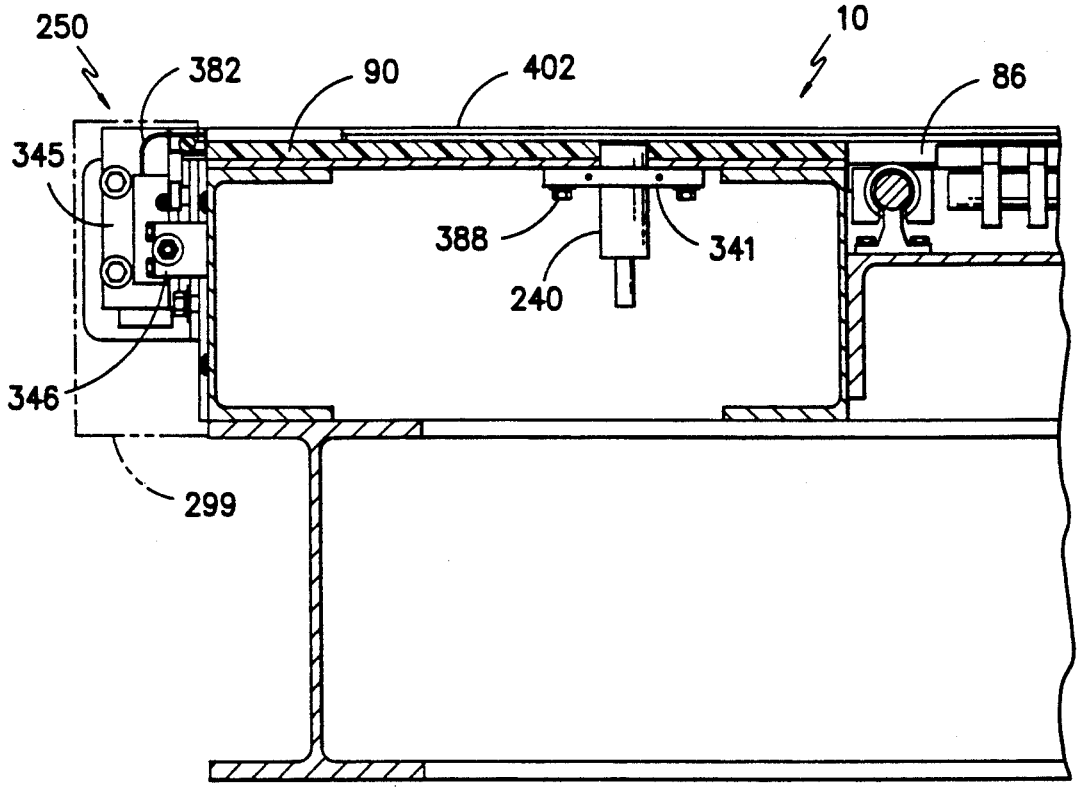
FIG. 18 is a cross-sectional view taken on line 18—18 of FIG. 17.
Figure 19:
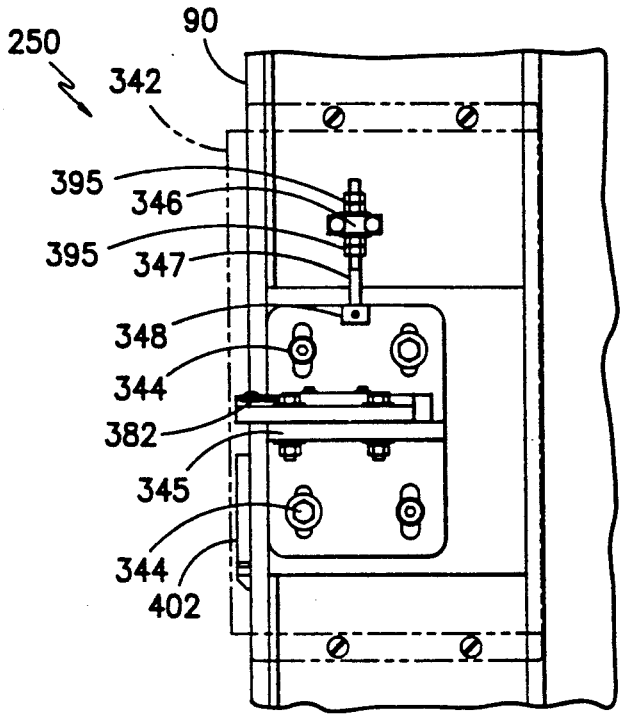
FIG. 19 is a cross-sectional view taken on line 19—19 of FIG. 17.

Referring now to FIGS. 1, 15 and 16, that disclose the transport link return guidance assembly 66, in which there are two dual wheels 230 on the underside of the conveyor mechanism 10 to hold the conveyor plates 86 in horizontal alignment with respect to the longitudinal axis of the conveyor mechanism 10. Both wheels 230 are mounted on a wheel guide base plate 307. Each wheel 230 has a bearing assembly 231 with a shaft 309 within a bearing housing 310 and attached by means of a bolt 311 to the base plate 307. The guide wheel base plate 307 is attached to the conveyor mechanism 10 by means of bolt and nut combination 312. There are two ball bearings 316 and 314 with ball bearing 314 being held in place by retaining rings 313 and 315 on each side. On the upper part of the conveyor mechanism 10 is a series of five guide rollers (not shown) to maintain the longitudinal alignment of the conveyor plates 86. FIG. 16 also reveals a conveyor plate 86 with associated slat 402 being aligned by a wheel 230.

Referring now to FIGS. 3, 15, 17, 18, 19, and 25, there are a pair of effector switch sensors 240 mounted underneath the conveyor mechanism 10 and held to the underside of the conveyor mechanism 10 by means of a clamp and associated cap assembly 34 and held into position by a series of screws and washers 388 and is directed upward on each side of the conveyor to detect the presence of carpet tiles or any other processed article and thereby feed this information into the control system of the processing equipment. The location of sensors the 240 is toward the rear of the conveyor mechanism 10, as shown in FIGS. 3 and 15. There is a start print sensor assembly is generally indicated at numeral 250 that actuates the control system in order to enable the computerized dyeing process. This start print sensor assembly 250 utilizes a high speed reflective sensor 382 and has a surrounding guard 299 to protect it and is mounted to the conveyor mechanism 10 by means of a base and clamp combination 345 that is attached to a mounting bracket 298 by means of conventional hardware 344 such as a shoulder bolts and/or cap screws. The mounting bracket 343 has oval holes through which shoulder bolts and cap screws connect to the conveyor mechanism 10. The mounting bracket 343 can be positioned by means of an adjustment rod 347 that is threadedly connected to an adjustment block 346. The adjustment block 346 is bolted to the side of the conveyor mechanism 10. The adjustment rod 347 is connected to extension of the mounting bracket by means of a set screw 348. There are nuts on each side of the adjustment rod 347 that alters the position of the mounting bracket 343.

Figure 20:
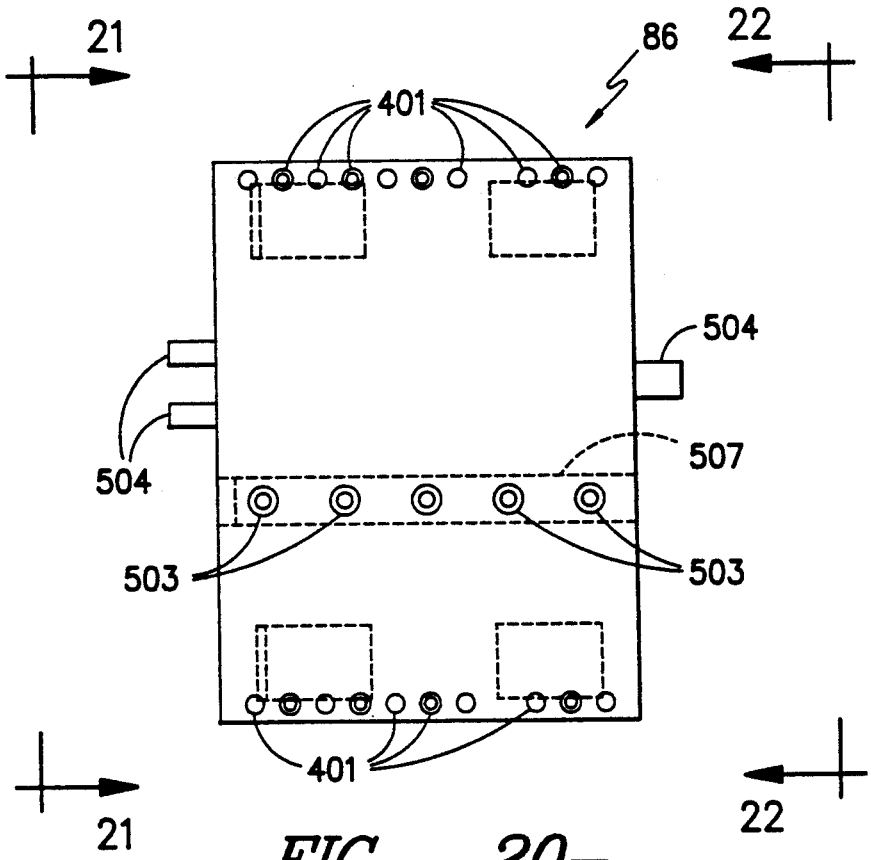
FIG. 20 is a top plan view of a conveyor plate.
Figure 21:
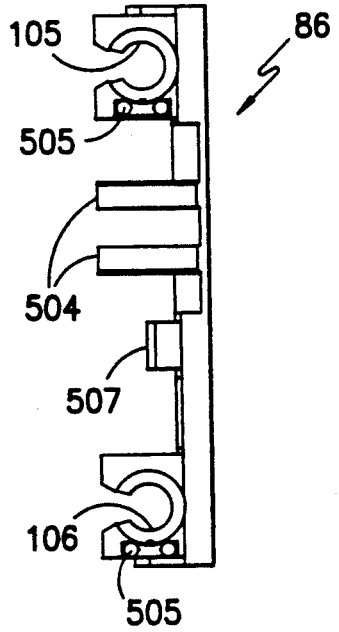
FIG. 21 is a cross-sectional view taken on line 21—21 of FIG. 20.
Figure 22:
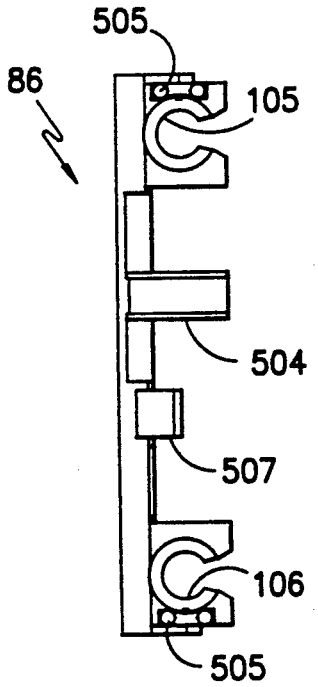
FIG. 22 is a cross-sectional view taken on line 22—22 of FIG. 20.

The conveyor plates 86 travel along a defined path along the center of the longitudinal path of the conveyor mechanism 10. As shown in FIGS. 20, 21, and 22, the conveyor plate is shown in detail with numerous tapped holes with assorted inserts 401 for the attachment of slats 402 at various positions depending on the size of carpet tile being processed. There is a longitudinal row of button head cap screws 503 positioned slightly off-center and to the right on the conveyor plate 86, in FIG. 20, that holds a rack gear 507 onto the underside of the conveyor plate 86. There are a pair of pillow block linear bearings 105, 106 that were previously disclosed in FIG. 4. There is also a retainer 505 that is held in place by a hex head screw and washer or equivalents thereof. There are linking and protruding interconnection portions 504 that are held in place by cup point socket set screws and serve to interconnect the conveyor plates 86 by linking pin joints 88. The rack gear 507 is an integral part of the drive means for the conveyor mechanism 10.

Figure 23:
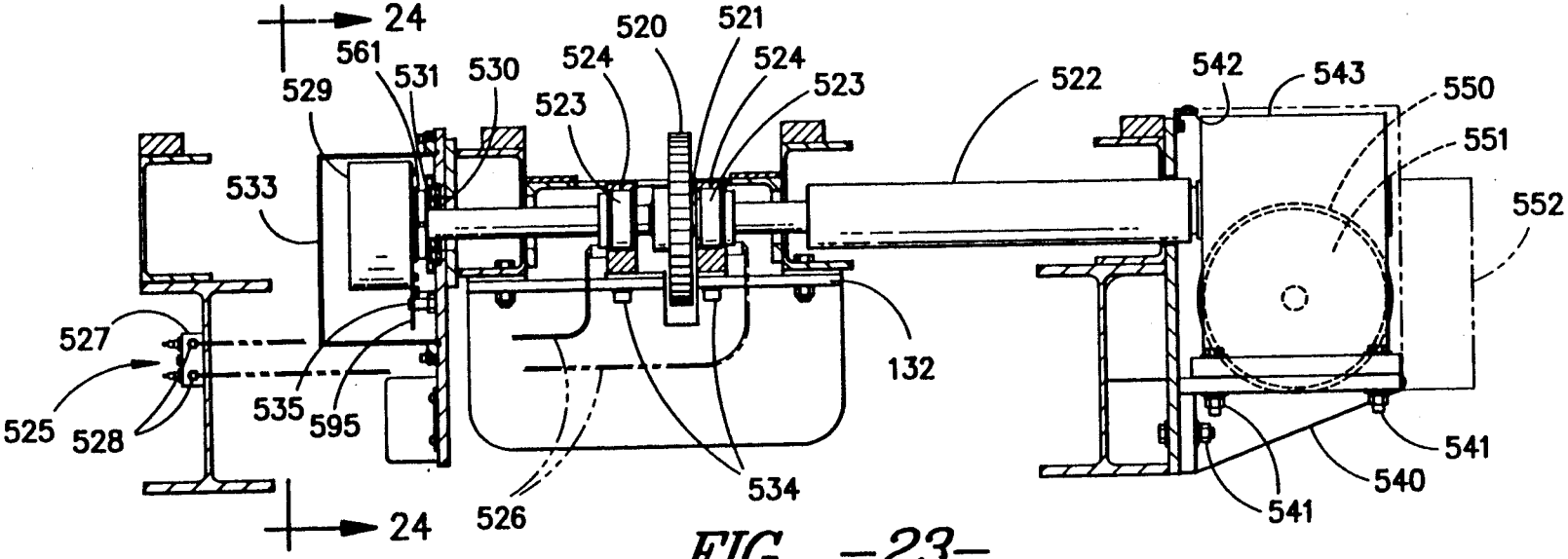
FIG. 23 is a cross-sectional view taken on line 23—23 of FIG. 2.
Figure 24:
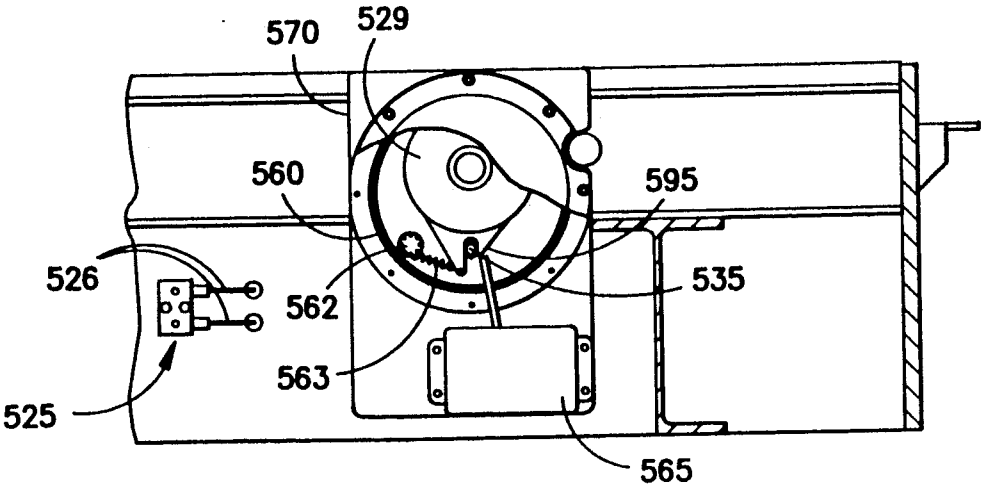
FIG. 24 is a cross sectional view taken on line 24—24 of FIG. 23.

Referring now to FIGS. 23 and 24, the conveyor plates 86 are powered by a drive gear 520 that is located toward the rear of the conveyor mechanism 10, as shown in FIG. 2 and interconnects with the rack gear 507 to power the conveyor mechanism 10. The drive gear 520 is fixedly attached to a drive shaft 522 by means of a retaining ring 521. There are a pair of bearings 523 mounted in bearing housings 524 on each side of the drive gear 520. The housings 524 are bolted 534 or equivalent means thereof to the intermediate level 132 of the conveyor. The bearings 523 are lubricated by a series of conduits 526 which run from the bearing housings 524 to a grease fitting generally indicated as numeral 525 including a block 527 and male connectors 528. The drive shaft 522 is also connected to an optical incremental encoder 529 with a rawhide seal 530 and encoder seal 531, from left to right as shown on FIG. 23. The encoder 529 also has a mounting bushing 561 as well as cover 533 and torque arm 535. The opposite side of shaft 522 is connected to a gear reducer 543 that has a 60:1 ratio with a guard bracket 542 and a lower mounting bracket 540 that is attached by means of bolts 541 to the conveyor mechanism 10 and the gear reducer 543. There is a motor 550, preferable a 240 volt, 2 horsepower, 1750 r.p.m. electric motor, which is connected to the gear reducer 543 by means of an adaptor 551 and partially housed in a main drive cover 552.

Referring now to FIG. 24, the optical encoder 529 has a mounting base 570 as well as an o-ring 560 to mount thereon. The encoder 529 has a spring stud 562 with a spring 563 attached thereto that connects to and controls the torque arm 595. There is also an encoder junction box 565 as well as a torque arm stud 535.

Therefore, it is not intended that the scope of the invention be limited to the specific embodiment illustrated and described. Rather, it is intended that the scope of the invention be defined by the appended claims and their equivalents.

What is claimed is:

1. An apparatus for applying liquids to a moving material comprising of a conveyor apparatus for conveying said material in a predetermined path of travel that includes a first planar portion having a longitudinal axis, a first endless flexible element adjacent said first planar portion and coplanar therewith and a second planar portion having a longitudinal axis and adjacent said first endless flexible element and coplanar therewith and at least one slat removedly attached upon said first endless flexible element for movement therewith and extending across said first planar portion and transverse to the longitudinal axis of said first planar portion as well as extending across said second planar portion and transverse to the longitudinal axis of said second planar portion for transporting said material which is supported by said first planar portion, said first endless flexible element, and said second planar portion and is in direct contact therewith, a liquid applicator means having a row of outlets extending across and positioned above the material path for discharging a corresponding row of generally parallel, undeflected primary streams of liquid on a trajectory of said primary streams of liquid directed toward the material path, a source of electrically encoded pattern data, gas passage means positioned adjacent to said row of outlets and aligned with the discharge axes of the outlets for selective deflecting, in accordance with pattern data from such data source, the trajectory of said primary stream streams of liquid emerging from said outlets with streams of gas from said gas passage means that intersects said primary streams of liquid, a liquid collection chamber positioned adjacent to said outlets and opposite from said gas passage means, said liquid collection chamber having an opening that extends along said row of outlets and that is positioned to receive said gas streams and primary liquid streams deflected by said gas streams.

2. A conveyor apparatus for transporting material comprising:

(a) a first planar portion having a longitudinal axis;

(b) a first endless flexible element adjacent said first planar portion and coplanar therewith;

(c) a second planar portion having a longitudinal axis adjacent said first endless flexible element and coplanar therewith; and (d) at least one slat removedly attached upon said first endless flexible element for movement therewith and extending across said first planar portion and transverse to the longitudinal axis of said first planar portion as well as extending across said second planar portion and transverse to the longitudinal axis of said second planar portion for transporting said material which is supported by said first planar portion, said first endless flexible element, and said second planar portion and is in direct contact therewith and said conveyor apparatus has a first end portion and a second end portion located at opposite ends of said conveyor apparatus and a means for removing articles of said material from one of said end portions of said conveyor apparatus comprising of an elongated finger that moves between a first and second position whereby said elongate finger contacts at least one of said articles in said first position and lifts said article from said conveyor apparatus to a second endless flexible element when said elongate finger moves to said second position and a means for detecting the presence of at least one of said articles that activates said elongate finger.

3. A conveyor apparatus as defined in claim 2, wherein said means for detecting the presence of at least one of said articles includes a fiber optic sensor.

4. A conveyor apparatus for transporting material comprising:

(a) a first planar portion having a longitudinal axis;

(b) a first endless flexible element adjacent said first planar portion and coplanar therewith;

(c) a second planar portion having a longitudinal axis adjacent said first endless flexible element and coplanar therewith; and (d) at least one slat removedly attached upon said first endless flexible element for movement therewith and extending across said first planar portion and transverse to the longitudinal axis of said first planar portion as well as extending across said second planar portion and transverse to the longitudinal axis of said second planar portion for transporting said material which is supported by said first planar portion, said first endless flexible element, and said second planar portion and is in direct contact therewith and said conveyor apparatus has a first end portion and a second end portion located at opposite ends of said conveyor apparatus and a means for removing articles of said material from one of said end portions of said conveyor apparatus comprising of a plurality of elongate fingers that move between a first and second position whereby said elongate fingers contact at least one of said articles in said first position and lifts said article from said conveyor apparatus to a second endless flexible element when said elongate fingers move to said second position and a means for detecting the presence of at least one of said articles that activates said plurality of elongate fingers.

5. A conveyor apparatus as defined in claim 4, wherein said means for detecting the presence of at least one of said articles includes a fiber optic sensor.

6. A conveyor apparatus as defined in claim 1, in which said conveyor apparatus has a first end portion and a second end portion located at opposite ends of said conveyor apparatus and a means for removing articles of said material from one of said end portions of said conveyor apparatus comprising of at least one elongate finger that moves between a first and second position whereby said elongate finger contacts at least one of said articles in said first position and lifts said article from said conveyor apparatus to a second endless flexible element when said elongate finger moves to said second position.

7. A conveyor apparatus as defined in claim 6, in which said finger is actuated by a cylinder.

8. An apparatus for applying liquids to a moving material comprising of a conveyor apparatus for conveying said material in a predetermined path of travel that includes a first planar portion having a longitudinal axis, a first endless flexible element adjacent said first planar portion and coplanar therewith and a second planar portion having a longitudinal axis and adjacent said first endless flexible element and coplanar therewith and at least one slat removedly attached upon said first endless flexible element for movement therewith and extending across said first planar portion and transverse to the longitudinal axis of said first planar portion as well as extending across said second planar portion and transverse to the longitudinal axis of said second planar portion for transporting said material which is supported by said first planar portion, said first endless flexible element, and said second planar portion and is in direct contact therewith, a liquid applicator means having a row of outlets extending across and positioned above the material path for discharging a corresponding row of generally parallel, undeflected primary streams of liquid on a trajectory of said primary streams of liquid directed toward the material path, a source of electrically encoded pattern data, gas passage means positioned adjacent to said row of outlets and aligned with the discharge axes of the outlets for selective deflecting, in accordance with pattern data from such data source, the trajectory of said primary stream streams of liquid emerging from said outlets with streams of gas from said gas passage means that intersects said primary streams of liquid, a liquid collection chamber positioned adjacent to said outlets and opposite from said gas passage means, said liquid collection chamber having an opening that extends along said row of outlets and that is positioned to receive said gas streams and primary liquid streams deflected by said gas streams and said conveyor apparatus has a first end portion and a second end portion located at opposite ends of said conveyor apparatus and a means for removing articles of said material from one of said end portions of said conveyor apparatus comprising of at least one elongate finger that moves between a first and second position whereby said elongate finger contacts at least one of said articles in said first position and lifts said article from said conveyor apparatus to a second endless flexible element when said elongate finger moves to said second position and a means for detecting the presence of at least one of said articles that activates said elongate finger.

9. A conveyor apparatus as defined in claim 8, wherein said means for detecting the presence of at least one of said articles includes a fiber optic sensor.

10. A conveyor apparatus as defined in claim 6, in which said second endless flexible element encircles a pair of cylindrical rolls.

11. A conveyor apparatus as defined in claim 6, in which said second endless flexible element encircles a plurality of cylindrical rolls.

12. An apparatus for applying liquids to moving articles of material comprising of a frame assembly and a moveable inclined conveyor apparatus for conveying the articles of material in a predetermined path of travel that includes a first planar portion having a longitudinal axis, a first endless flexible element adjacent said first planar portion and coplanar therewith and a second planar portion having a longitudinal axis and adjacent said first endless flexible element and coplanar therewith and at least one slat removedly attached upon said first endless flexible element for movement therewith and extending across said first planar portion and transverse to the longitudinal axis of said first planar portion as well as extending across said second planar portion and transverse to the longitudinal axis of said second planar portion for transporting said articles of material which are supported by said first planar portion, said first endless flexible element, and said second planar portion and is in direct contact therewith, a liquid applicator means attached to said frame assembly and having a row of outlets extending across and positioned above the articles of material path for discharging a corresponding row of generally parallel, undeflected primary streams of liquid on a trajectory of said primary streams of liquid directed toward the articles of material path, a source of electrically encoded pattern data, gas passage means positioned adjacent to said row of outlets and aligned with the discharge axes of the outlets for selective deflecting, in accordance with pattern data from such data source, the trajectory of said primary stream streams of liquid emerging from said outlets with streams of gas from said gas passage means that intersects said primary streams of liquid, a liquid collection chamber positioned adjacent to said outlets and opposite from said gas passage means, said liquid collection chamber having an opening that extends along said row of outlets and that is positioned to receive said gas streams and primary liquid streams deflected by said gas streams and a means for moving said inclined conveyor apparatus underneath and away from said liquid applicator means for processing various heights of the articles of material and a means for locking said inclined conveyor apparatus into at least one of a plurality of positions.

13. An apparatus for applying liquids to moving articles of material comprising of a frame assembly and a moveable inclined conveyor apparatus for conveying the articles of material in a predetermined path of travel that includes a first planar portion having a longitudinal axis, a first endless flexible element adjacent said first planar portion and coplanar therewith and a second planar portion having a longitudinal axis and adjacent said first endless flexible element and coplanar therewith and at least one slat removedly attached upon said first endless flexible element for movement therewith and extending across said first planar portion and transverse to the longitudinal axis of said first planar portion as well as extending across said second planar portion and transverse to the longitudinal axis of said second planar portion for transporting said articles of material which are supported by said first planar portion, said first endless flexible element, and said second planar portion and is in direct contact therewith, a liquid applicator means attached to said frame assembly and having a row of outlets extending across and positioned above the articles of material path for discharging a corresponding row of generally parallel, undeflected primary streams of liquid on a trajectory of said primary streams of liquid directed toward the articles of material path, a source of electrically encoded pattern data, gas passage means positioned adjacent to said row of outlets and aligned with the discharge axes of the outlets for selective deflecting, in accordance with pattern data from such data source, the trajectory of said primary stream streams of liquid emerging from said outlets with streams of gas from said gas passage means that intersects said primary streams of liquid, a liquid collection chamber positioned adjacent to said outlets and opposite from said gas passage means, said liquid collection chamber having an opening that extends along said row of outlets and that is positioned to receive said gas streams and primary liquid streams deflected by said gas streams and a means for moving said inclined conveyor apparatus underneath and away from said liquid applicator means for processing various heights of the articles of material and a means for locking said inclined conveyor apparatus into at least one of a plurality of positions and said means for moving said conveyor apparatus underneath and away from said liquid applicator means further comprises a motor attached to said frame assembly having a rotating shaft with a pulley attached thereto which winds and unwinds a cable attached to said conveyor apparatus for moving said conveyor apparatus underneath and away from said liquid applicator means to process various heights of material.

14. A conveyor apparatus as defined in claim 12, wherein said means for locking said conveyor apparatus into at least one of a plurality of positions further comprises a locking means including a first means to receive a pin located in said conveyor apparatus and a second means to receive said pin located in said frame assembly.

15. An apparatus for applying liquids to moving articles of material comprising of a frame assembly and a moveable inclined conveyor apparatus for conveying the articles of material in a predetermined path of travel that includes a first planar portion having a longitudinal axis, a first endless flexible element adjacent said first planar portion and coplanar therewith and a second planar portion having a longitudinal axis and adjacent said first endless flexible element and coplanar therewith and at least one slat removedly attached upon said first endless flexible element for movement therewith and extending across said first planar portion and transverse to the longitudinal axis of said first planar portion as well as extending across said second planar portion and transverse to the longitudinal axis of said second planar portion for transporting said articles of material which are supported by said first planar portion, said first endless flexible element, and said second planar portion and is in direct contact therewith, a liquid applicator means attached to said frame assembly and having a row of outlets extending across and positioned above the articles of material path for discharging a corresponding row of generally parallel, undeflected primary streams of liquid on a trajectory of said primary streams of liquid directed toward the articles of material path, a source of electrically encoded pattern data, gas passage means positioned adjacent to said row of outlets and aligned with the discharge axes of the outlets for selective deflecting, in accordance with pattern data from such data source, the trajectory of said primary stream streams of liquid emerging from said outlets with streams of gas from said gas passage means that intersects said primary streams of liquid, a liquid collection chamber positioned adjacent to said outlets and opposite from said gas passage means, said liquid collection chamber having an opening that extends along said row of outlets and that is positioned to receive said gas streams and primary liquid streams deflected by said gas streams and a means for moving said inclined conveyor apparatus underneath and away from said liquid applicator means for processing various heights of the articles of material and a means for locking said inclined conveyor apparatus into at least one of a plurality of positions and said means for locking said conveyor apparatus into at least one of a plurality of positions further comprises a cam means and a cam holding means to hold said cam means in a fixed position and at least one sensor to detect if said cam is located within said cam holding means.

16. An apparatus for applying liquids to moving articles of material comprising of a frame assembly and a moveable inclined conveyor apparatus for conveying the articles of material in a predetermined path of travel that includes a first planar portion having a longitudinal axis, a first endless flexible element adjacent said first planar portion and coplanar therewith and a second planar portion having a longitudinal axis and adjacent said first endless flexible element and coplanar therewith and at least one slat removedly attached upon said first endless flexible element for movement therewith and extending across said first planar portion and transverse to the longitudinal axis of said first planar portion as well as extending across said second planar portion and transverse to the longitudinal axis of said second planar portion for transporting said articles of material which are supported by said first planar portion, said first endless flexible element, and said second planar portion and is in direct contact therewith, a liquid applicator means attached to said frame assembly and having a row of outlets extending across and positioned above the articles of material path for discharging a corresponding row of generally parallel, undeflected primary streams of liquid on a trajectory of said primary streams of liquid directed toward the articles of material path, a source of electrically encoded pattern data, gas passage means positioned adjacent to said row of outlets and aligned with the discharge axes of the outlets for selective deflecting, in accordance with pattern data from such data source, the trajectory of said primary stream streams of liquid emerging from said outlets with streams of gas from said gas passage means that intersects said primary streams of liquid, a liquid collection chamber positioned adjacent to said outlets and opposite from said gas passage means, said liquid collection chamber having an opening that extends along said row of outlets and that is positioned to receive said gas streams and primary liquid streams deflected by said gas streams and a means for moving said inclined conveyor apparatus underneath and away from said liquid applicator means for processing various heights of the articles of material and a means for locking said inclined conveyor apparatus into at least one of a plurality of positions and at least one sensor for determining the relative position of said conveyor apparatus in relation to said frame assembly.

17. A conveyor apparatus as defined in claim 1, in which said material is detected by at least one sensor means prior to treatment by said undeflected primary streams of liquid.

18. An apparatus for applying liquids to a moving material comprising of a conveyor apparatus for conveying said material in a predetermined path of travel that includes a first planar portion having a longitudinal axis, a first endless flexible element adjacent said first planar portion and coplanar therewith and a second planar portion having a longitudinal axis and adjacent said first endless flexible element and coplanar therewith and at least one slat removedly attached upon said first endless flexible element for movement therewith and extending across said first planar portion and transverse to the longitudinal axis of said first planar portion as well as extending across said second planar portion and transverse to the longitudinal axis of said second planar portion for transporting said material which is supported by said first planar portion, said first endless flexible element, and said second planar portion and is in direct contact therewith, a liquid applicator means having a row of outlets extending across and positioned above the material path for discharging a corresponding row of generally parallel, undeflected primary streams of liquid on a trajectory of said primary streams of liquid directed toward the material path, a source of electrically encoded pattern data, gas passage means positioned adjacent to said row of outlets and aligned with the discharge axes of the outlets for selective deflecting, in accordance with pattern data from such data source, the trajectory of said primary stream streams of liquid emerging from said outlets with streams of gas from said gas passage means that intersects said primary streams of liquid, a liquid collection chamber positioned adjacent to said outlets and opposite from said gas passage means, said liquid collection chamber having an opening that extends along said row of outlets and that is positioned to receive said gas streams and primary liquid streams deflected by said gas streams and said first endless flexible element includes a plurality of plates connected together by means of pins and linear pillow block bearings mounted underneath said plates that are supported by cylindrical shafts for movement thereon.

19. A conveyor apparatus for transporting material comprising:

(a) a first planar portion having a longitudinal axis;

(b) a first endless flexible element adjacent said first planar portion and coplanar therewith;

(c) a second planar portion having a longitudinal axis adjacent said first endless flexible element and coplanar therewith; and (d) at least one slat removedly attached upon said first endless flexible element for movement therewith and extending across said first planar portion and transverse to the longitudinal axis of said first planar portion as well as extending across said second planar portion and transverse to the longitudinal axis of said second planar portion for transporting said material which is supported by said first planar portion, said first endless flexible element, and said second planar portion and is in direct contact therewith and further comprising of linear pillow block bearings mounted underneath said plates that are supported by cylindrical shafts for movement thereon.

20. An apparatus for applying liquids to moving articles of material comprising of a frame assembly and a moveable inclined conveyor apparatus for conveying the articles of material in a predetermined path of travel that includes a first planar portion having a longitudinal axis, a first endless flexible element adjacent said first planar portion and coplanar therewith and a second planar portion having a longitudinal axis and adjacent said first endless flexible element and coplanar therewith and at least one slat removedly attached upon said first endless flexible element for movement therewith and extending across said first planar portion and transverse to the longitudinal axis of said first planar portion as well as extending across said second planar portion and transverse to the longitudinal axis of said second planar portion for transporting said articles of material which are supported by said first planar portion, said first endless flexible element, and said second planar portion and is in direct contact therewith, a liquid applicator means attached to said frame assembly and having a row of outlets extending across and positioned above the articles of material path for discharging a corresponding row of generally parallel, undeflected primary streams of liquid on a trajectory of said primary streams of liquid directed toward the articles of material path, a source of electrically encoded pattern data, gas passage means positioned adjacent to said row of outlets and aligned with the discharge axes of the outlets for selective deflecting, in accordance with pattern data from such data source, the trajectory of said primary stream streams of liquid emerging from said outlets with streams of gas from said gas passage means that intersects said primary streams of liquid, a liquid collection chamber positioned adjacent to said outlets and opposite from said gas passage means, said liquid collection chamber having an opening that extends along said row of outlets and that is positioned to receive said gas streams and primary liquid streams deflected by said gas streams and a means for moving said inclined conveyor apparatus underneath and away from said liquid applicator means for processing various heights of the articles of material and a means for locking said inclined conveyor apparatus into at least one of a plurality of positions and said means for moving said conveyor apparatus underneath and away from said liquid applicator means further comprises a plurality of linear bearings attached to said conveyor apparatus which engage and are supported by cylindrical shafts mounted to said frame assembly to provide movement of said conveyor apparatus.

21. A conveyor apparatus as defined in claim 18, in which said plurality of plates are aligned underneath said conveyor apparatus by means of at least one pair of rotatable circular flanged members which are adapted to be received within said plurality of plates.

* * * * *